US005199353A

United States Patent [19]

Szyszko

[11] Patent Number: 5,199,353

[45] Date of Patent: Apr. 6, 1993

[54] PRINTING MACHINE PALLET ASSEMBLY

[75] Inventor: Aleksander Szyszko, Carol Stream, Ill.

[73] Assignee: M&R Printing Equipment, Inc., Glen Ellyn, Ill.

[21] Appl. No.: 711,086

[22] Filed: Jun. 6, 1991

[51] Int. Cl.[5] ..... B41F 1/28

[52] U.S. Cl. ..... 101/474; 101/126

[58] Field of Search ..... 101/474, 114, 115, 123, 101/124, 35, 41, 44, 126; 38/135, 136

[56] References Cited

U.S. PATENT DOCUMENTS 1,688,281 10/1982 MacDonald ..... 101/114
4,819,559 4/1989 Szarka ..... 101/474
4,958,559 9/1990 Bubley et al. ..... 101/123
5,016,367 5/1991 Breen et al. ..... 38/135

FOREIGN PATENT DOCUMENTS 0774764 5/1957 United Kingdom ..... 101/114

*Primary Examiner*—Edgar S. Burr
*Assistant Examiner*—Anthony H. Nguyen
*Attorney, Agent, or Firm*—Wallenstein, Wagner & Hattis

[57] ABSTRACT

A pallet assembly for a printing machine used to print designs on garments such as tee shirts. The pallet assembly generally forms the outline of a human torso, arms and neck. The assembly is comprised of a pair of arm members rotatably attached to a plate.

12 Claims, 2 Drawing Sheets

PRINTING MACHINE PALLET ASSEMBLY

DESCRIPTION

1. Technical Field

The present invention relates to a printing machine pallet assembly having rotatable arm members for receiving, securing and smoothly holding a garment, such as a tee shirt, to the pallet assembly for printing.

2. Background Of The Invention

Printing machines that use pallets to support garments during printing are well known in the art. Conventionally, garments are printed on printing machines by placing the garment over a rectangular or similarly shaped pallet assembly carried on the printing press. The pallet assembly is positioned under a screen embodying the indicia to be printed, and printed by applying ink through the screen in a manner well-known in the art.

Pallet assemblies are typically flat and somewhat rectangular in shape. This allows garments with large surface areas, such as the body of a tee shirt, jacket or the like, to be easily pulled over and smoothed out onto the pallet assembly. These flat, rectangular pallet assemblies, however, suffer from several shortcomings. Since many garments are not rectangular in shape, they do not entirely fit over the pallet assembly. For example, while the material that forms the body of a shirt will fit over the pallet assembly, the material that forms the arms will hang over the sides. Since the material is not fully stretched flat, misprints can occur. Also, printing a design on both the body and the arms of a garment requires two separate printing operations—one for the body and another for the arms. Not only is this extra printing operation time consuming, it is detrimental to producing a continuous design on both the body and the arms of the garment. A misalignment in the two separate printing operations results in a discontinuity where the two portions of the single design are joined.

Another problem is that the same pallet is often used for a garment that comes in several sizes. Consequently, smaller garments may fit snugly over the pallet assembly whereas other garments will fit loosely. Unfortunately, loose fitting garments are subject to move or shift on a pallet during printing. This movement is undesirable when multiple color designs are printed because each color is applied separately, and movement results in misalignment or poor registration of the colors. Eliminating this movement is especially important for the automatic and semi-automatic multi-stage printing machines used today. Garments that fit loosely over the pallet assembly are also more likely to be wrinkled during printing. As stated above, wrinkled garments result in breaks in the print design that is transferred onto the garment and reduce the quality of the finished product.

The present invention solves these and other problems.

SUMMARY OF THE INVENTION

The present invention relates to a pallet assembly for printing machines that print designs on garments such as tee shirts. In the preferred embodiment, the pallet assembly comprises a pair of rotatable arm members attached to a plate. The rotatable arm members extend outwardly from the periphery of the plate such that the pallet generally outlines the contours of a human torso, shoulders, arms and neck.

The arm members may be rotated into up and down positions. When the arm members are in the up position, an operator can easily pull a garment over the pallet assembly or remove a garment from the pallet assembly. As the arms of the garment reach the pallet, the arm members are moved to the down position, filling the garment arms so they are smoothly secured to the pallet assembly. In addition, the surfaces of each arm member are flush with the surfaces of the plate when in the down position to ensure printing on a smooth flat surface.

One advantage of the present invention is that the arm members provide a surface over which additional portions of a garment, such as a tee shirt sleeve, can be smoothly laid. Thus, a print design can be transferred to the additional portion of the garment while the remainder of the design is being transferred to the body of the garment.

Another advantage of the present invention is that the arm members provide an additional means for securing the garment to the pallet assembly during printing. This is particularly important for multi-stage printing machines because the garment is held in place during each stage of the printing process and, thereby, improves the alignment or registration of the several colors used to form the completed design.

A further advantage of the present invention is that a garment, such as a tee shirt, will not have to be stretched over outwardly extending arm members, but, instead, can be slipped over arm members that have been rotated into an up position. Thus, the unstretched garment will lie smoothly and snugly over the pallet assembly so that the printed design can be cleanly and continuously transferred to the garment.

Still a further advantage of the present invention is that the arm members tend to slightly stretch the garment when the arms are rotated into a down position. This helps to smooth out any wrinkles in the garment before printing and, thereby ,achieve a quality print design.

Other advantages and aspects of the invention will become apparent upon making reference to the specification, claims and drawings to follow.

DETAILED DESCRIPTION OF THE PREFERRED EMBODIMENT

Figure 1:
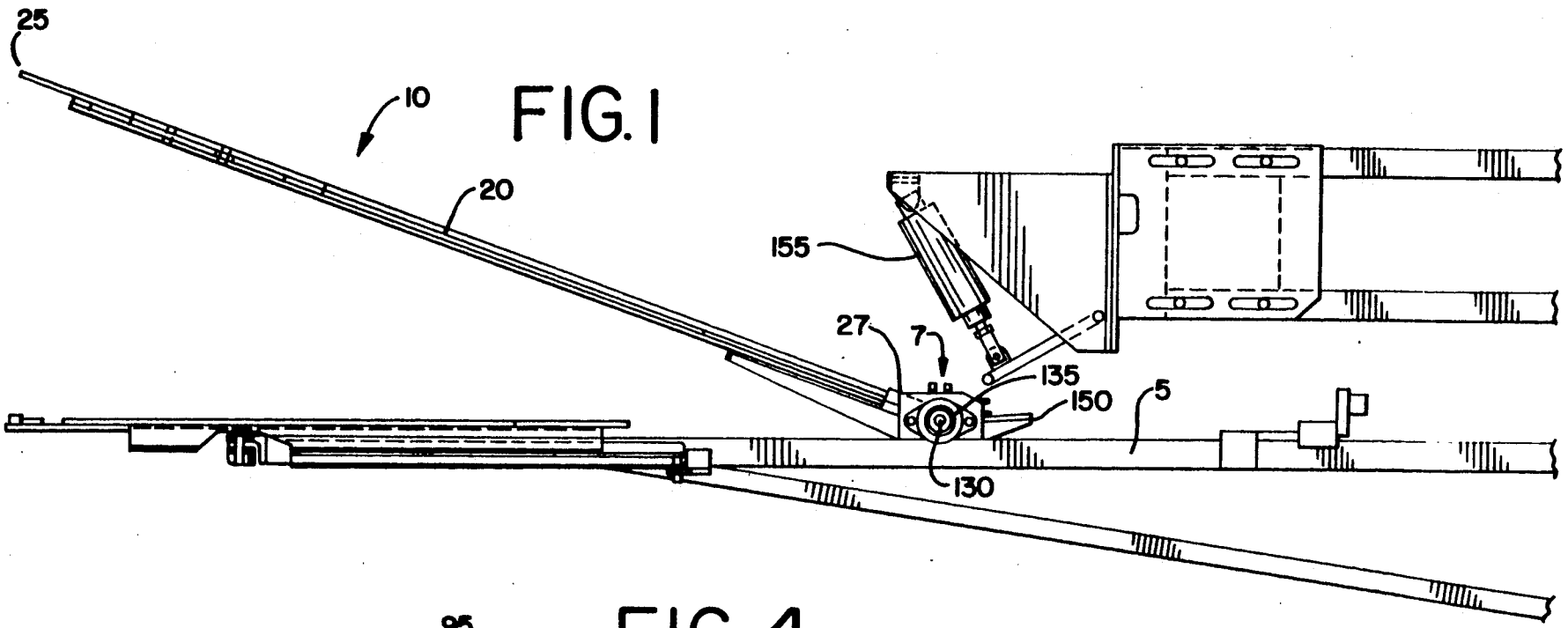
FIG. 1 is a side view of the pallet assembly of the present invention showing the pallet assembly attached to a base assembly of a printing machine.
Figure 4:
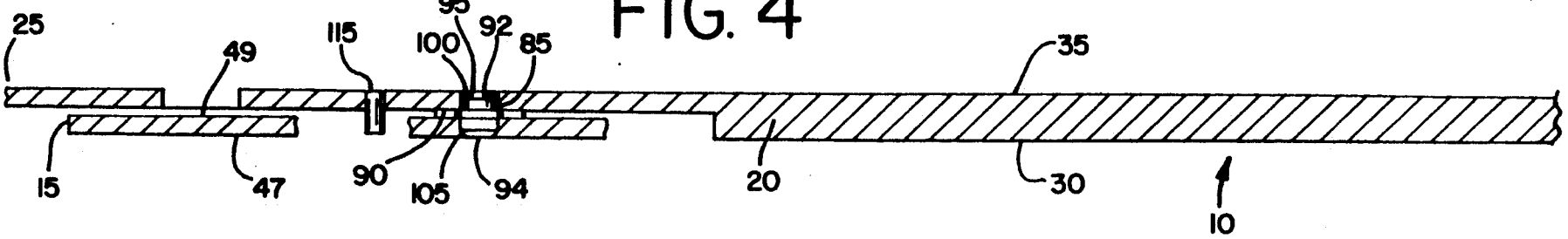
FIG. 4 is a side view of the pallet assembly.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspects of the invention to the embodiment illustrated.

Figure 2:
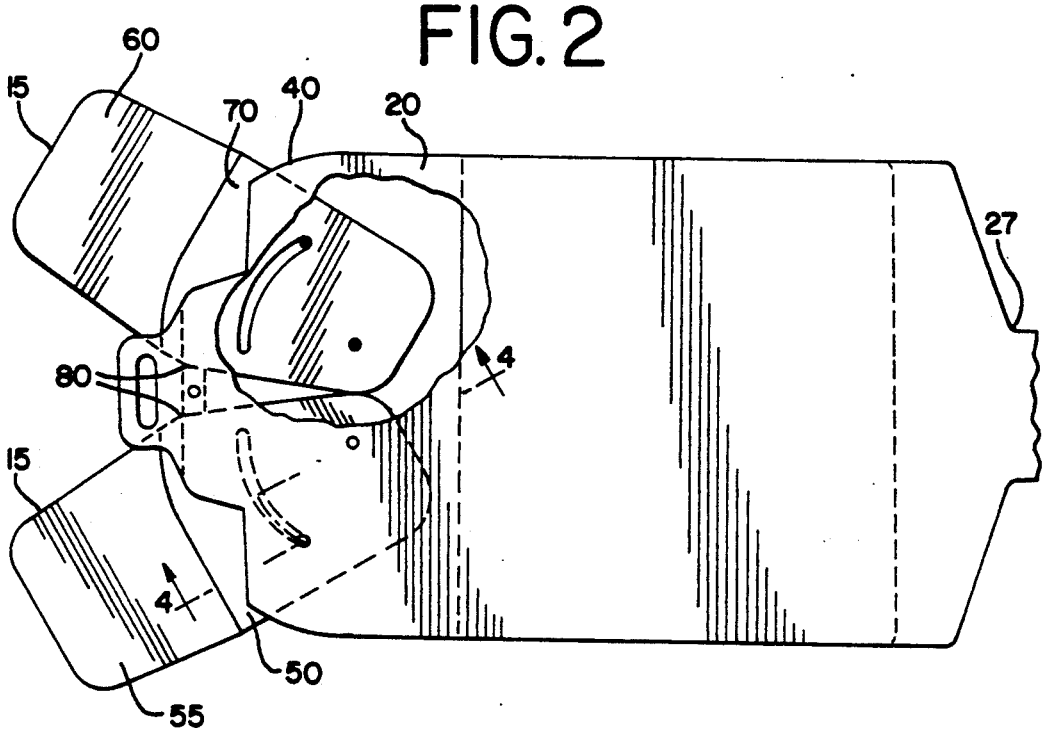
FIG. 2 is a top view of the pallet assembly showing the arm members in an up position.
Figure 3:
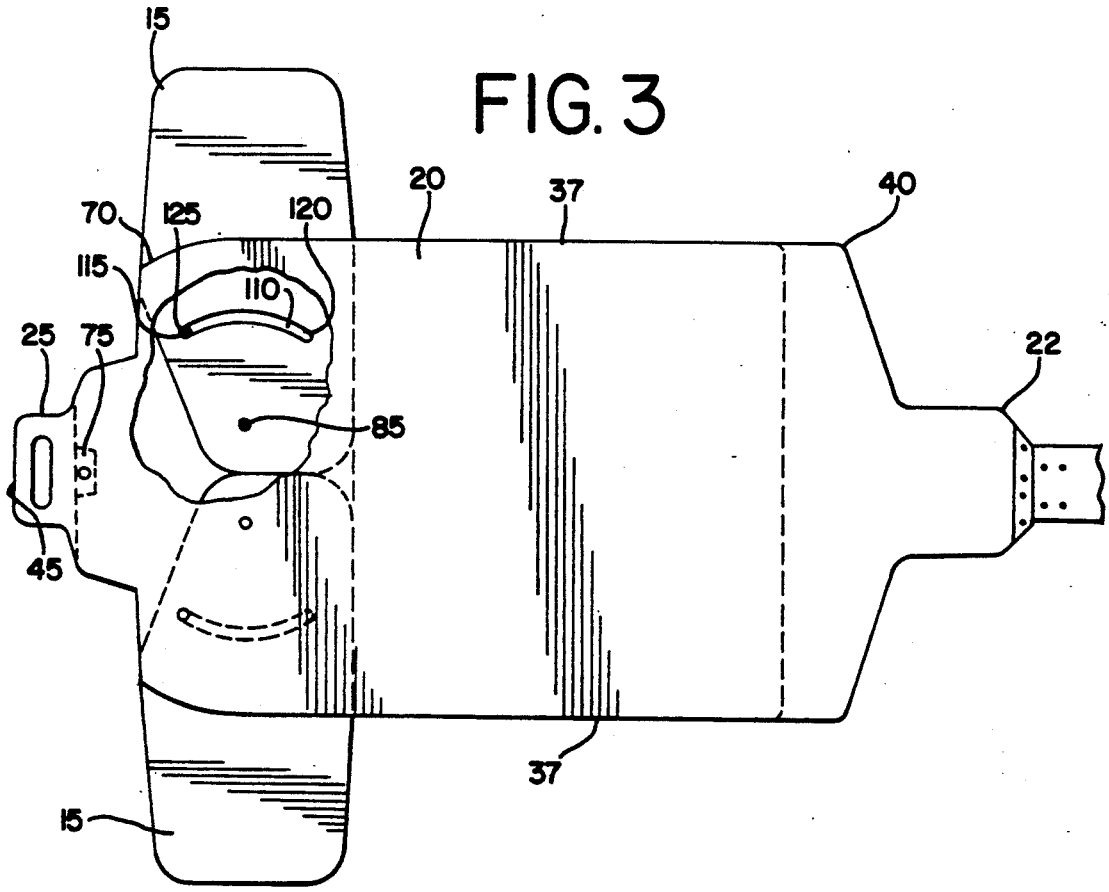
FIG. 3 is a top view of the pallet assembly showing the arm members in a down position.

As shown in FIGS. 1, 2 and 3, the present invention pertains to pallet assembly 10 that is attached to the base assembly 5 of a typical printing machine (not shown). In the preferred embodiment, the pallet assembly 10 is comprised of a plate 20 and a pair of arm members 15 rotatably attached thereto. The plate 20 has a free end 25 which is not attached to the printing machine, and a fixed end 27 which is attached to the printing machine. The free end 25 is opposite the fixed end 27. The plate 20 has substantially flat outside surfaces 30 and 35 and side edges 37. The plate 20 is preferably made of a metal such as aluminum. It is also generally rectangular in shape with rounded corners 40. The plate 20 is approximately 1/16 inch thick and has a handle portion 45 formed integral with the free end 25. The plate 20 can be made of various sizes to accommodate various sizes of garments.

Referring to FIGS. 2 and 3, the arm members 15 have outer surfaces 47 and 49, and are comprised of a thin portion 50 and a thick portion 55. The thin portion 50 of the arm members 15 is attached to the plate 20 at the milled corners 40. The thick portion 55 of the arm members 15 extends outwardly from the periphery of the plate 20. The additional thickness of the thicker portion 55 is produced by attaching a plate 60 to one of the outside surfaces 49 of each of the arm members 15. These plates 60 are shaped to fit flush with the periphery of the thick portion 55 of the arm members 15. The plate 60 is approximately the same thickness as the plate 20. The plates 60 are also shaped so that their inner edge 70 abuts the side edge 37 of plate 20 when the arm members 15 are in the down position. The outer surface of the plates 60 are flush with the outside surface 35 of the plate 20. This provides a flat surface for printing on surface 35.

Each of the corners 40 of the plate 20 located at the free end 25 are milled to accommodate arm members 15 such that the outside surface 47 of the arm members 15 are flush with the outside surface 30 of the plate 20 to provide a continuous flat surface for printing. The corners 40 are milled to the thickness of the thin portion 50 of the arm members 15 and to accommodate the arm members 15 throughout their cycle of rotation.

A spacer 75 is attached to the surface 30 of the plate 20. Spacer 75 is sized so that its side edges 80 are flush with the side edge 37 of the plate 20. Spacer 75 is shaped so that its side edges 80 provide surfaces against which the arm members 15 can abut when rotated in the up position. Spacer 75 is of a thickness approximately equal to that of the thin portion 50 of arm member 15.

Each arm member 15 is rotatably attached to the plate 20 by a pin 85 and bushing 90 assembly. Each pin 85 has two ends 92 and 94 and a middle portion 95. The diameter of the pin 85 is sized so that the ends 92 and 94 of the pin 85 can be pressure fit into a slightly smaller diameter opening or hole 100 in the plate 20. Each of the arm members 15 is provided with an opening or hole 105 that is slightly larger than the diameter of the pin 85. This allows the arm members 15 to rotate about the pin 85.

The middle 95 of each pin 85 is surrounded by the bushing 90 that spaces the arm member 15 from the pin 85 and the plate 20. The preferably nylon bushings 90 are compressed between the middle 95 of each pin 85 and the opening 105 in the arm member 15. This compression creates sufficient friction to prevent the arm members 15 from rotating unless pushed upon by an operator.

As shown in FIGS. 2 and 3, each arm member 15 is provided with a slot 110 and guide member 115. In the preferred embodiment, the slot 110 is formed in each of the arm members 15. Each slot 110 is arcuate in shape so that it is a constant radius from the pin 85. The guide members 115 are attached to the plate 20, extend into their respective slots 110, and remain in that slot 110 when the arm members 15 are rotated about their respective pin 85. The length of each arcuate slot 110 defines the range through which the arm members 15 rotate. When an arm member 15 is rotated upwardly, its guide member 115 engages one end or abutment 120 of the slot 110. Similarly, when an arm member 15 is rotated downwardly, its guide member 115 engages a second end or abutment 125 of the slot 110.

FIG. 3 shows the arm members 15 in the down position. This is the position the arm members 15 are in during the printing process. In this position, the arm members 15 extend outwardly from the side edges 37 plate 20. When in the down position, the pallet assembly 10 generally forms an outline similar to that of a human torso, arms and neck. This shape also resembles the shape of many garments, such as tee shirt, and allows the garment to smoothly fit over the pallet assembly 10 and, thereby, facilitates the printing of quality designs on those garments. In addition, when the arm members 15 are in the down position, they help secure the garment to the pallet assembly 10 because the garment cannot slide off the free end 25 or easily rotate around the side edges 37 of the plate 20.

FIG. 2 shows the arm members 15 rotated in an up position. In this position, the arm members 15 are rotated upwardly and toward each other so that the arm members 15 extend outwardly from the free end 25 of the plate 20. This facilitates pulling the garment over or removing the garment from the pallet assembly 10. The material forming the torso of a garment will not have to be stretched over the outwardly extending arm members 15. This unstretched garment will lie more smoothly over the pallet assembly 10. In fact, for many garments the torso will fit snugly over the pallet assembly 10. As stated above, this smooth fit allows for better quality designs to be printed on the garment.

In another embodiment, a second plate covers the exposed surface 47 of the arm members 15. The arm members 15 are then sandwiched between the plate 20 and the second plate. This ensures a totally flat printing surface on both sides of the pallet.

In the preferred embodiment, the pallet assembly 10 is attached to a base assembly 5 such that it can be raised and flipped with respect to the base member 5. The means for raising 7 allows the pallet assembly 10 to rise above the base assembly 5 and facilitates pulling a garment over or removing a garment from the pallet assembly 10. The raising means comprises a bar 130 held by bearings 135. The bearings 135 are attached to the base assembly 5. The bar 130 has, through its center, a transaxial opening. A shaft extends from the rear of the pallet assembly 10. The shaft is adapted to be inserted into the opening in the bar 130. The shaft is free to rotate within the opening 130.

Extending from the rear of the pallet assembly 10 is an extension 150. To raise the pallet assembly 10, an air cylinder 155 is adapted to press downward on the extension 150. The downward pressure on the extension 150 forces the free end 25 of the pallet assembly 10 to raise.

A means for flipping allows both outside surfaces 30 and 35 of the plate 20 to face upwardly during the printing process. Thus, a design can be printed on both the front and back sides of a garment without removing the garment from the pallet assembly 10. The pallet assembly 10 is flipped after it is raised as described above. To flip the pallet assembly 10, the operator grasps the handle 45 and rotates the pallet assembly 10.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

What I claim is:

1. In combination:

printing means for applying inked indicia to a garment; and a pallet assembly connected to said printing means for supporting said garment during the inking thereof, said pallet assembly including a first plate around which the body of a garment is to be disposed to receive on a side thereof ink for forming a pattern, said plate having a pair of outside surfaces, a free end, a fixed end and a periphery, and means for presenting a flat garment body surface to the ink applying means of said printing means comprising a pair of arm members around which the sleeves of said garment are to be disposed to stretch the body of said garment and thereby flatten the same, said pair of arm members being rotatably attached to said plate, and extending from opposite sides of the periphery of said plate said arms being rotatable toward each other to a position in which they extend from the free end of said plate to facilitate/application of the garment around said plate and arm members and away from each other so that the arm members project in opposite directions and extend outwardly from said periphery of said plate, wherein said arm members of said pallet assembly have a thin portion over one of said plate outside surfaces and a thicker portion opposite to said periphery.

2. The combination of claim 1 wherein said plate of said pallet assembly has a pair of corners at said free end milled to accommodate said thin portion of said arm member.

3. The combination of claim 1 wherein each of said arm members of said pallet assembly has outside surfaces flush with said outside surfaces of said plate.

4. The combination of claim 1 further comprising means attached to said plate of said pallet assembly to form an abutment against which said arm members contact when rotated a predetermined degree.

5. The combination of claim 1 wherein each of said arm members of said pallet assembly is rotatably attached to said plate by a pin and bushing assembly.

6. The combination of claim 5 wherein said plate and arm members have openings therein, said pins have first and second ends and a middle portion, said openings in said plate are smaller in diameter than said pin, said openings in said arm members are larger in diameter than said pin, said first end of said pin is attached to said plate by pressure fitting said first end into said openings in said plate, and said middle portion of said pin is surrounded by said bushing, said bushing spacing said arm member from said pin.

7. The combination of claim 1 wherein each of said arm members of said pallet assembly has a slot therein, and said plate has a pair of guide members attached thereto, one of said guide members projecting into each of said slots of said arm members to guide rotation of said arm members.

8. The combination of claim 1 further comprising means for raising said pallet assembly.

9. The combination of claim 8 wherein said raising means comprises:

a bar having first and second ends and a transaxial opening through generally the center thereof;

a shaft axially attached to said fixed end of said plate, said shaft adapted for rotatable insertion in said transaxial opening in said bar;

a bearing at each of said first and second ends of said bar to allow axial rotation of said bar;

an extension attached to said shaft; and, an air cylinder adapted to press downward on said extension.

10. The combination of claim 9 further comprising means for flipping said pallet assembly.

11. The combination of claim 10 wherein said flipping means comprises a handle attached to said free end of said plate which is rotated to allow flipping of said plate axially about said shaft.

12. A pallet assembly for a printing machine that prints on garments, the pallet assembly comprising:

a plate having a pair of outside surfaces, a free end, a fixed end and a periphery; and, a pair of arm members rotatably attached to said plate and extending outwardly from said periphery of said plate, each of said arm members being rotatably attached to said plate by a pin and bushing assembly, and wherein said plate and arm embers have openings therein, said pins have first and second ends and a middle portion, said openings in said plate are smaller in diameter than said pin, said openings in said arm members are larger in diameter than said pin, said first end of said pin is attached to said plate by pressure fitting said first end into said openings in said plate, and said middle portion of said pin is surrounded by said bushing, said bushing spacing said arm member from said pin.

* * * * *